US005941203A

United States Patent [19]

Sato

[11] Patent Number: 5,941,203

[45] Date of Patent: Aug. 24, 1999

[54] VALVE TIMING CONTROL DEVICE

[75] Inventor: Atsushi Sato, Toyota, Japan

[73] Assignee: Aisin Seiki Kabushiki Kaisha, Aichi-pref., Japan

[21] Appl. No.: 09/100,035

[22] Filed: Jun. 19, 1998

[30] Foreign Application Priority Data

Jun. 24, 1997 [JP] Japan ..... 9-167687

[51] Int. Cl.[6] ..... F01L 1/344; F01L 13/00

[52] U.S. Cl. ..... 123/90.17; 123/90.31; 74/568 R; 464/2; 464/160

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 5,361,735 | 11/1994 | Butterfield et al. | 123/90.17 |
| 5,450,825 | 9/1995 | Geyer et al. | 123/90.31 |
| 5,724,929 | 3/1998 | Mikame et al. | 123/90.17 |
| 5,785,026 | 7/1998 | Moriya | 123/90.17 |
| 5,794,577 | 8/1998 | Kira | 123/90.17 |
| 5,794,579 | 8/1998 | Moriya | 123/90.17 |

FOREIGN PATENT DOCUMENTS

| | | |
|---|---|---|
| 1-92504 | 4/1989 | Japan . |
| 2-50105 | 4/1990 | Japan . |
| 9-60508 | 3/1997 | Japan . |
| 10-47022 | 2/1998 | Japan . |

*Primary Examiner*—Weilun Lo
*Attorney, Agent, or Firm*—Hazel & Thomas, P.C.

[57] ABSTRACT

A valve timing control device for controlling the opening/closing timing of the intake valve or exhaust valve of an internal combustion engine comprises: a valve opening/closing rotary shaft rotatably assembled with the cylinder head of the internal combustion engine; a rotor integrally provided on the rotary shaft; a rotation transmitting member including a first mounting portion which is mounted around the peripheral surface of the rotor and a second mounting portion which is mounted around the peripheral surface of the rotary shaft, so as to rotate relative thereto within a predetermined range for transmitting a rotating power from a crank pulley; a plurality of vanes provided on the rotor or the rotation transmitting member; a fluid chamber formed between the rotor and the rotation transmitting member and separated into advancing chambers and delaying chambers by the vanes; first fluid passages for feeding and discharging a fluid to and from the advancing chambers; and second fluid passages for feeding and discharging the fluid to and from the delaying chambers; wherein the clearance between the first mounting portion of the rotation transmitting member and the peripheral surface of the rotor is smaller than the clearance between the second mounting portion of the rotation transmitting member and the peripheral surface of the rotary shaft.

3 Claims, 5 Drawing Sheets

VALVE TIMING CONTROL DEVICE

BACKGROUND OF THE INVENTION

1. Field of the Invention

The present invention relates to a valve timing control device to be used for controlling the opening/closing timing of an intake valve or an exhaust valve in a valve actuating mechanism of an internal combustion engine.

2. Description of the Related Art

In Unexamined Published Japanese Patent Application No. Hei 1-92504 or Unexamined Published Japanese Utility Model Application No Hei 2-50105, for example, there is disclosed a valve timing control device, comprising a valve opening/closing rotary shaft rotatably assembled with the cylinder head of the internal combustion engine; a rotor integrally provided on the rotary shaft; a rotation transmitting member including a first mounting portion which is mounted around the peripheral surface of the rotor and a second mounting portion which is mounted around the peripheral surface of the rotary shaft, so as to rotate relative thereto within a predetermined range for transmitting rotating power from a crank pulley; a plurality of vanes provided on the rotor or the rotation transmitting member; a fluid chamber formed between the rotor and the rotation transmitting member and separated into advancing chambers and delaying chambers by the vanes; first fluid passages for feeding and discharging a fluid to and from the advancing chambers; and second fluid passages for feeding and discharging the fluid to and from the delaying chambers.

The valve timing control device, as described in each of the above-cited patent applications has both a first clearance and a second clearance. The first clearance is made between the first mounting portion of the rotation transmitting member and the peripheral surface of the rotor. The first clearance has influence on the amount of the fluid leaking from the fluid chamber. The second clearance is made between the second mounting portion of the rotation transmitting member and the peripheral surface of the rotary shaft. The second clearance has influence on making the rotation transmitting member and the rotary shaft positioned coaxially. In the above-mentioned valve timing control device, no consideration has been paid to the size of the clearances.

Thereby, it could be strong resistance at the first clearance and/or the second clearance, which is caused by the dimensions in the error range. The friction force between the rotation transmitting member and the rotary shaft may become bigger, if the error in the dimension of the rotational transmitting member and the rotary shaft was bigger in manufacturing

SUMMARY OF THE INVENTION

The invention has been conceived to solve the above-specified problems. According to the inventions there is provided a valve timing control device for controlling the opening/closing timing of the intake valve or exhaust valve of an internal combustion engine comprises; a valve opening/closing rotary shaft rotatably assembled with the cylinder head of the internal combustion engine; a rotor integrally provided on the rotary shaft; a rotation transmitting member including a first mounting portion which is mounted around the peripheral surface of the rotor and a second mounting portion which is mounted around the peripheral surface of the rotary shaft, so as to rotate relative thereto within a predetermined range for transmitting a rotating power from a crank pulley; a plurality of vanes provided on the rotor or the rotation transmitting member; a fluid chamber formed between the rotor and the rotation transmitting member and separated into advancing chambers and delaying chambers by the vanes; first fluid passages for feeding and discharging the fluid to and from the advancing chambers; second fluid passages for feeding and discharging the fluid to and from the delaying chambers, wherein the clearance between the first mounting portion of the rotation transmitting member and the peripheral surface of the rotor is smaller than clearance between the second mounting portion of the rotation transmitting member and the peripheral surface of the rotary shaft.

Other and further objects, features and advantages of the invention will appear more fully from the following description.

BRIEF DESCRIPTION OF THE DRAWINGS

FIG. 4 is a view similar to FIG. 2 but shows a state in which the internal rotor and the vanes are slightly rotated clockwise from the state of FIG. 2 relative to the external rotor and so on;

FIG. 7 is a view similar to FIG. 4 but shows a state in which the internal rotor and the vanes are rotated clockwise to a predetermined extent from the state of FIG. 4 relative to the external rotor and so on;

DESCRIPTION OF THE PREFERRED EMBODIMENT

One embodiment of the invention will be described with reference to the accompanying drawings.

Figure 1:
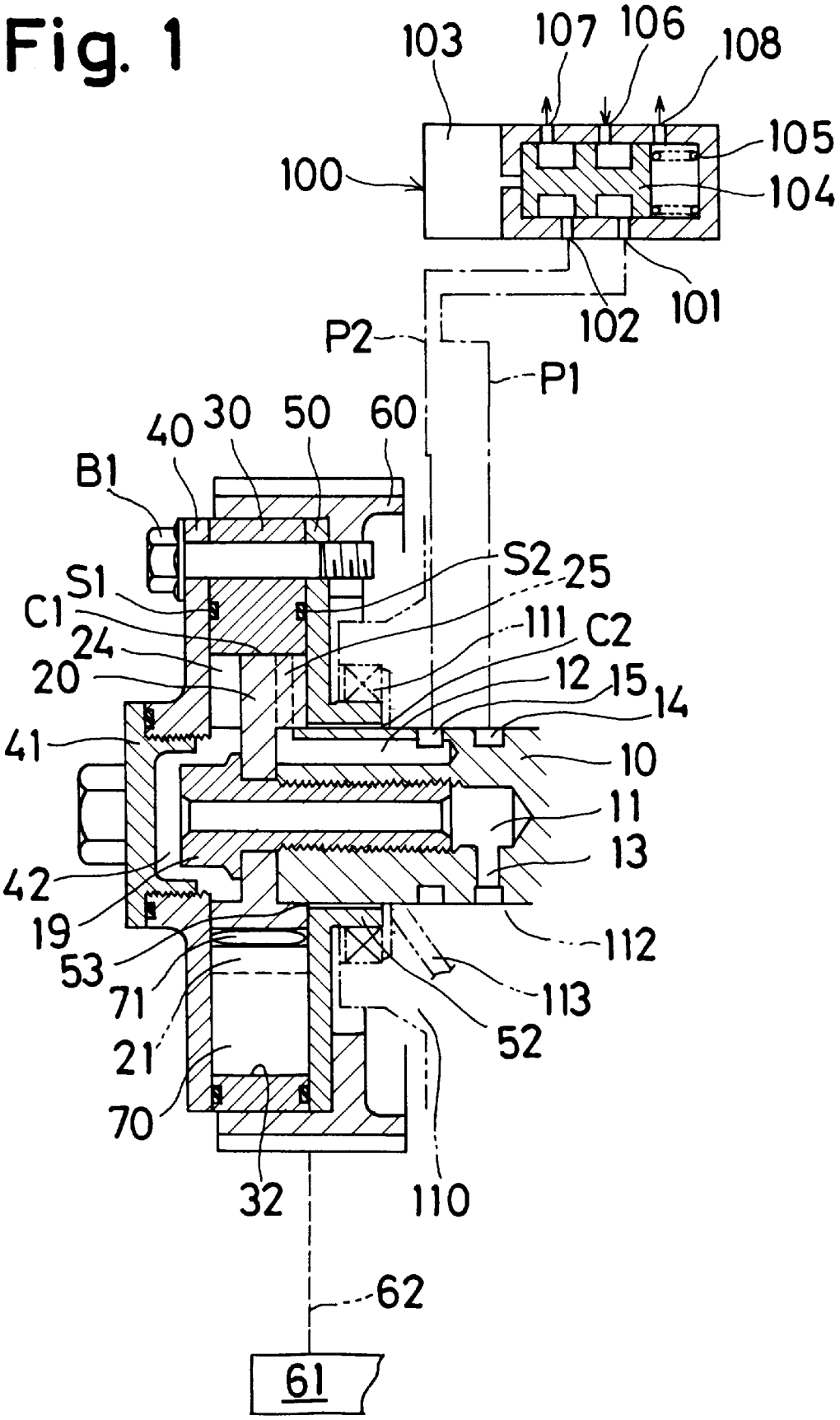
FIG. 1 is a longitudinal section schematically showing one embodiment of a valve timing control device according to the invention.
Figure 2:
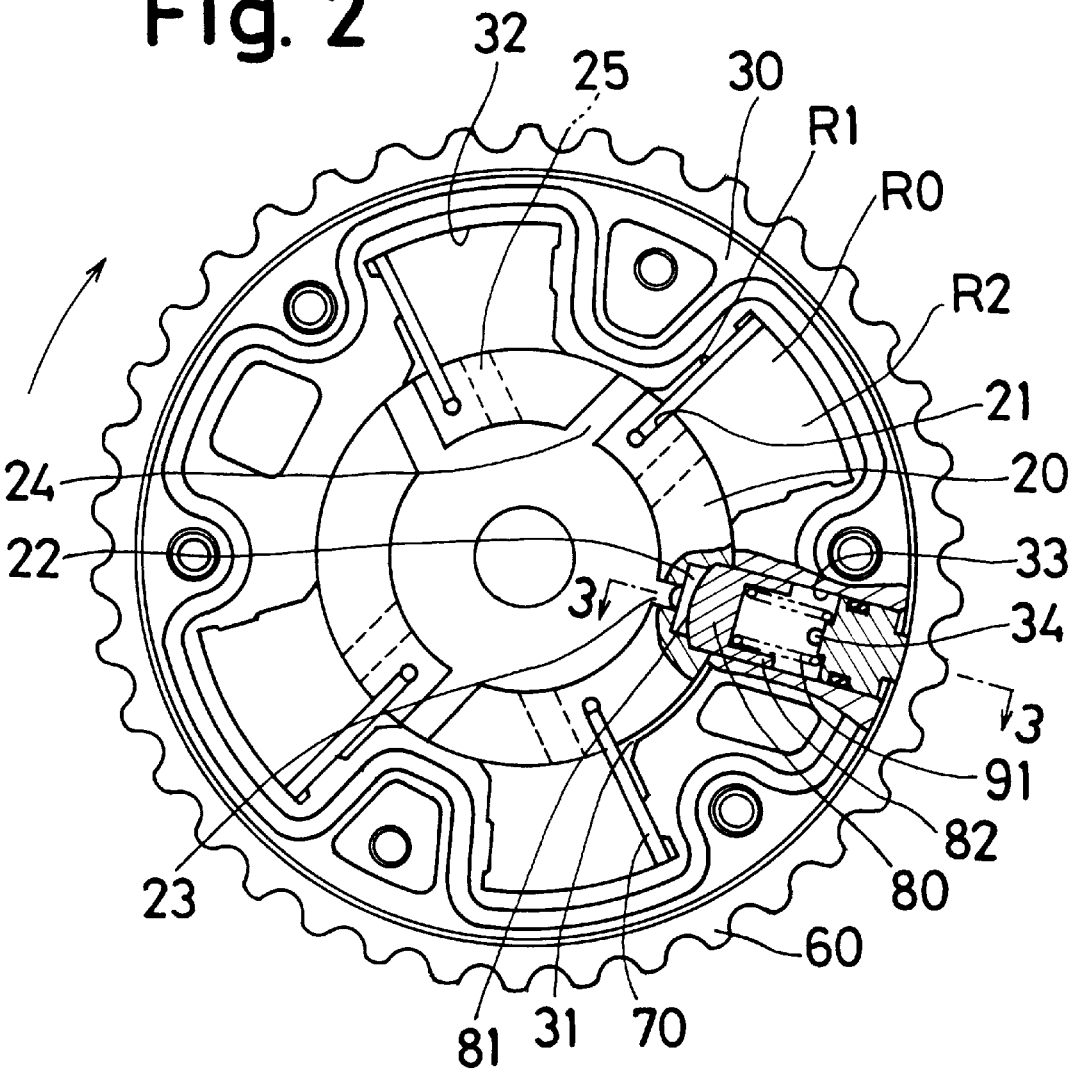
FIG. 2 is a partially broken front view showing the relation among an internal rotor, an external rotor, vanes, a lock pin, a timing pulley and so on, as shown in FIG. 1.
Figure 3:
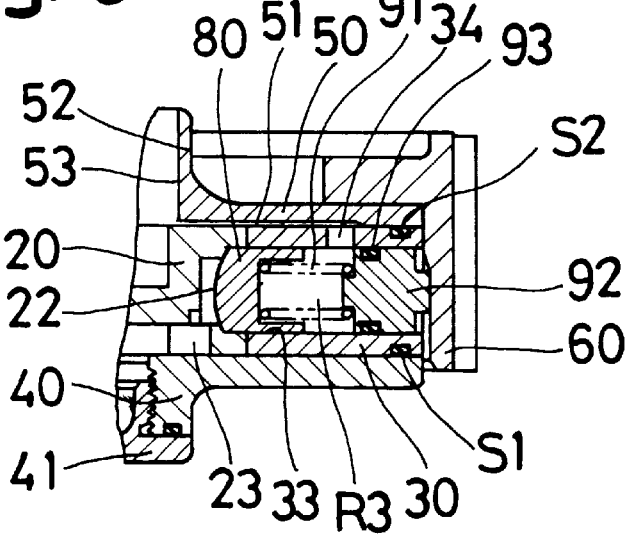
FIG. 3 is a section taken along line 3—3 of FIG. 2.

A valve timing control device according to the invention, as shown in FIGS. 1 to 3, is constructed so as to comprise a valve opening/closing shaft including a cam shaft 10 rotatably supported by a cylinder head 110 of an internal combustion engine, and an internal rotor 20 integrally provided on the leading end portion of the cam shaft 10; a rotation transmitting member mounted around the rotary shaft as to rotate relative thereto within a predetermined range and including an external rotor 30, a front plate 40, a cap 41, a rear plate 50 and a timing pulley 60; four vanes 70 assembled with the internal rotor 20; and a lock pin 80 assembled with the external rotor 30. Here, the timing pulley 60 is constructed, as is well known in the art, to transmit the rotating power to the clockwise direction of FIG. 2 from the crank pulley 61 through a timing belt 62 of a resin or rubber shown in FIG. 1.

The cam shaft 10 is equipped with the well-known cam (although not shown) for opening/closing an intake valve or an exhaust valve (although not shown) and is provided therein with an advance passage and a delay passage, which extend in the axial direction of the cam shaft 10. The advance passage 11 is connected to a connection port 101 of a change-over valve 100 via a radial passage 13, an annular passage 14 and a connection passage P1. On the other hand, the delay passage 12 is connected to a connection port 102 of the change-over valve 100 via an annular passage 15 and a connection passage P2.

The change-over valve 100 is enabled to move the spool 104 rightward of FIG. 1 against the action of a spring 105 by energizing a solenoid 103. The change-over valve 100 is so constructed as to establish, when deenergized, the communication between a feed port 106, as connected to an oil pump (although not shown) to be driven by the internal combustion engine, and the connection port 101 and the communication between the connection port 102 and an exhaust port 107. The valve 100 is further constructed as to establish, when energized, the communication between the feed port 106 and the connection port 102 and the communication between the connection port 101 and an exhaust port 108. As a result, the working oil is fed to the advance passage 11, when the solenoid 103 is deenergized, and to the delay passage 12 when the same is energized.

The internal rotor 20 is integrally fixed in the cam shaft 10 by means of a hollow bolt 19 and is provided with vane grooves 21 for mounting the four vanes 70 individually in the radial directions. Further provided are a fitting hole 22 for fitting the head portion 81 of the lock pin 80 to a predetermined extent in the state shown in FIG. 2, where the cam shaft 10, the internal rotor 20 and the external rotor 30 are synchronized in a predetermined phase (or the most delayed position) relative to one another; a passage 23 for feeding/discharging the working oil to and from the fitting hole 22 via the advance passage 11; passages 24 for feeding/discharging the working oil to and from advancing chambers R1 (excepting that, as located at the righthand lower one of FIG. 2), as defined by the individual vanes 70, via the advance passage 11; and passages 25 for feeding/discharging the working oil to and from delaying chambers R2, as defined by the individual vanes 70, via the delay passage 12. To and from the advancing chamber R1 located at the righthand lower position of FIG. 2, the working oil is fed and discharged from the fitting hole 22 via a passage 31 formed in the external rotor 30. The fitting hole 22 is stepped to have a larger diameter at its outer end portion for receiving the head portion 81 of the lock pin 80 such that the top of the head portion 81 abuts against the step. For this, the diametrically larger portion is chamfered at its outer end. Here, each vane 70 is urged radially outward by a spring 71 (as shown in FIG. 1) fitted in the bottom portion of the vane groove 21.

In the inner circumference of the external rotor 30, the external rotor 30 is so assembled with the outer circumference of the internal rotor 20 as to rotate relative thereto within a predetermined range. There is a clearance C1 between the inner circumference of the external rotor 30 and the outer circumference of the internal rotor 20. The clearance C1 is set at a predetermined dimension which is a very small value, in which working oil lies. To the two sides of the external rotor 30, there are jointed the front plate 40 and the rear plate 50 through seal members S1 and S2. The external rotor 30 is integrally jointed to the internal rotor 20 together with the timing pulley 60 by means of a bolt B1. With the front plate 40, there is assembled a liquid-tight cap 41 to form a passage 42 for connecting the advance passage 11 of the cam shaft 10 and the passages 23 and 24 of the internal rotor 20. In the external rotor 30, on the other hand, there are formed a fluid pressure chamber R0 accommodating the individual vanes 70 and adapted to be separated into the advancing chambers R1 and the delaying chambers R2 by the individual vanes 70; and a refuge hole 33 formed in the radial direction of the external rotor 30 for accommodating the lock pin 80 and a spring 91 for urging the lock pin 80 toward the internal rotor 20.

The refuge hole 33 is closed liquid-tightly at its outer end by a plug 92 and a seal member 93 to form a back pressure chamber R3 at the back of the lock pin 80. This back pressure chamber R3 is in communication with the inside of the cylinder head 110, as shown in FIGS. 2 and 3, via a communication hole 34 formed in the external rotor 30 and communicating with the back pressure chamber R3, a communication groove 51 (which can be exemplified by a communication hole) formed in the rear plate 50 and communicating with the communication hole 34 at its radially outer end, a communication groove 53 formed axially in the inner circumference of a boss portion 52 (i.e., the portion is engaged at its outer circumference with an oil seal 111, assembled with the cylinder head 110 and rotatably assembled at its inner circumference with the cam shaft 10 via a clearance C2) of the rear plate 50, and a communication hole 113 formed in a cam shaft supporting portion 112 of the cylinder head 110. Here, the port of the communication hole 34 at the side of the refuge hole 33 is so arranged that it may not be shut off by a skirted portion 82 of the lock pin 80 even when the lock pin 80 is moved against the urging force of the spring 80 by the working oil which is fed to the fitting hole 22 via the passage 23. On the other hand, the plug 92 is prevented from coming out by the timing pulley 60.

The lock pin 80 is provided with the head portion 81 having a curved (or spherical) shape and the skirted portion 82, at which it is so fitted in the refuge hole 33 with a predetermined leakage clearance as to move radially relative to the external rotor 30, and is urged toward the internal rotor 20 by the spring 91. This enables the working oil to flow through the leakage clearance between the skirted portion 82 of the lock pin 80 and the refuge hole 33.

The valve timing control device thus constructed according to this embodiment is held in the locked state, where the internal combustion engine is stopped to stop the oil pump and to hold the change-over valve 100 in the state of FIG. 1 and where the head portion 81 of the lock pin 80 is fitted by a predetermined stroke into the fitting hole 22 to regulate the relative rotations of the internal rotor 20 and the external rotor 30, as shown in FIGS. 2 and 3. The working oil is not fed from the change-over valve 100 to the advance passage 11 of the cam shaft 10 even if the solenoid 103 of the change-over valve 100 is energized substantially simultaneously with the start of the internal combustion engine. Here, even if the lock pin 80 is unable to come into the fitting hole 22 when the internal combustion engine stops as a result of the misalignment of the refuge hole 33 and the fitting hole 22, the external rotor 30, the timing pulley 60 and so on are rotated clockwise, as shown in FIG. 2, because the pressure of the working oil of the advancing chambers R1 and the delaying chambers R2 is low at the start of the internal combustion engine. The internal rotor 20, the vanes 70 and so on are relatively rotated to the delay side to take the most delayed position in which the lock pin 81 is pushed into the fitting hole 22 by the spring 91.

When the solenoid 103 of the change-over valve 100 is switched from the energized state to the deenergized state while the internal combustion engine is being run to drive the oil pump, on the other hand, the working oil is fed from the change-over valve 100 to the advance passage 11 of the cam shaft 10 so that it is fed via the passage 42 and the individual passages 24 to the individual advancing chambers R1, and from the passage 42 via the passage 23 to the fitting chamber 22. At the same time, the working oil is discharged to the outside from the individual delaying chambers R2 via the individual chambers 25, the delay passage 12, the change-over valve 100 and so on.

Figure 4:
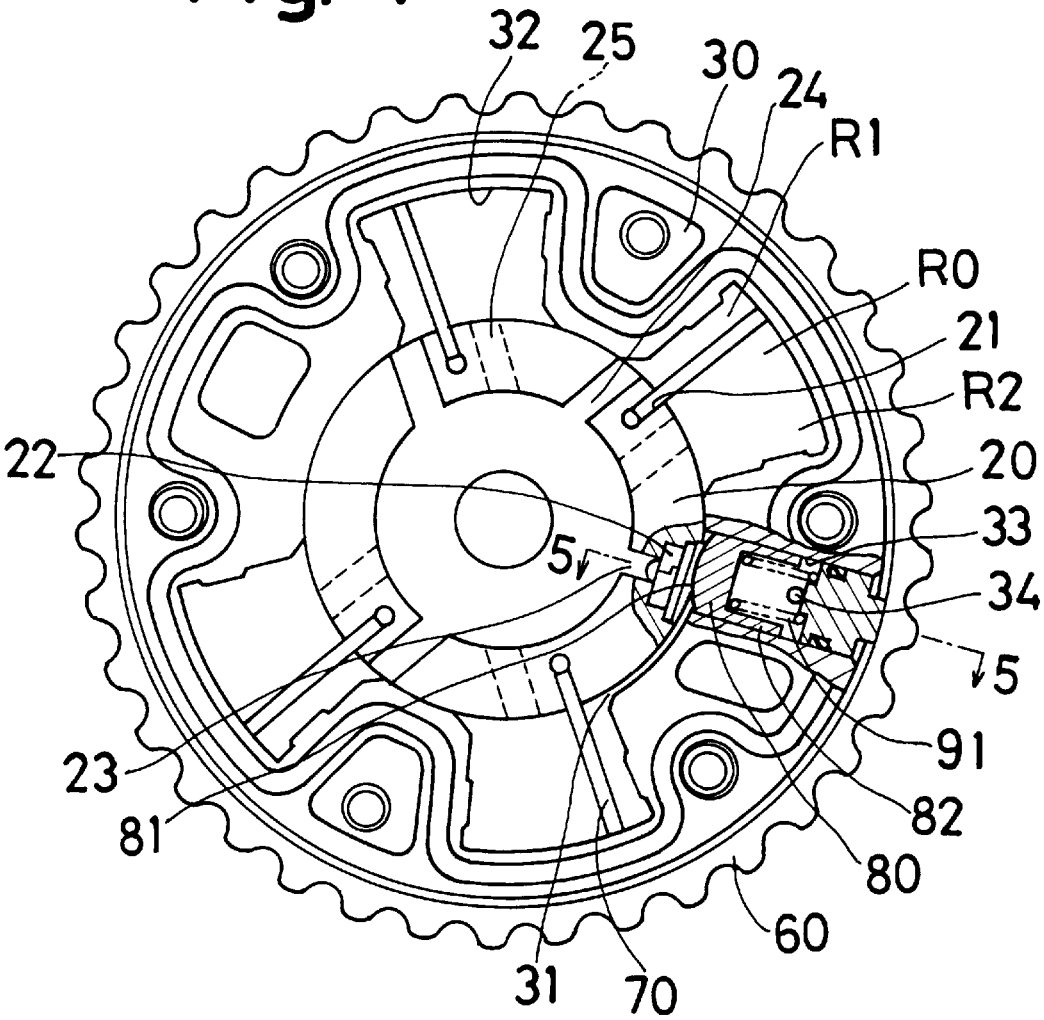
Figure 5:
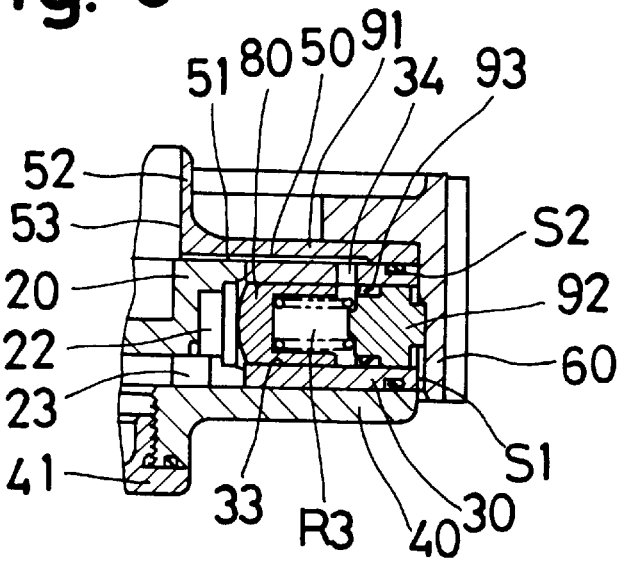
FIG. 5 is a section taken along line 5—5 of FIG. 4.

Here, as the working oil fed to the fitting hole 22 pushes the lock pin 80 against the spring 91, the lock pin 80 sequentially comes out of the fitting hole 22, and the rotary shaft side member including the cam shaft 10, the internal rotor 20 and the vanes 70 rotate relative to the rotation transmitting member including the external rotor 30 and the timing pulley 60, as shown in FIGS. 4 and 5. On the other hand, the working oil fed to the fitting hole 22 is fed to the advancing chamber R1, as located at the righthand lower side, via the passage 31 formed in the external rotor 30.

In the state where the curved head portion 81 of the lock pin 80 is partially fitted in the fitting hole 22, as shown in FIGS. 4 and 5, the rotary shaft side member including the cam shaft 10, the internal rotor 20 and the vanes 70 are allowed to rotate relative to the rotation transmitting member including the external rotor 30 and the timing pulley 60, so that the relative rotations of the rotary shaft side member and the rotation transmitting member are started before the entirety of the head portion 81 of the lock pin 80 comes out of the fitting hole 22. As a result, the time period from the inflow of the working oil into the fitting hole 22 to the relative rotations of the rotary shaft side member and the rotation transmitting member can be shortened to improve the working response of the device.

Figure 6:
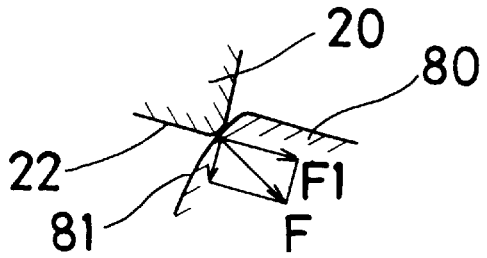
FIG. 6 is an enlarged section showing an essential portion of FIG. 4.

In the state where the head portion 81 of the lock pin 80 is partially fitted in the fitting hole 22, as shown in FIGS. 4 and 5, the lock pin 80 can be pushed to quickly come out of the fitting hole 22 not only by the working oil fed to the fitting hole 22 but also by a component F1 (as shown in FIG. 6) of the acting force F, which is established by the relative rotations of the rotary shaft side member and the rotation transmitting member and received by the lock pin 80. As a result, the working response of the device can also be improved to make a change in quick response from the state (the most delayed state) shown in FIGS. 2 and 3 through the state shown in FIGS. 4 to 6 to the state (the most advanced state) shown in FIGS. 7 and 8.

Figure 7:
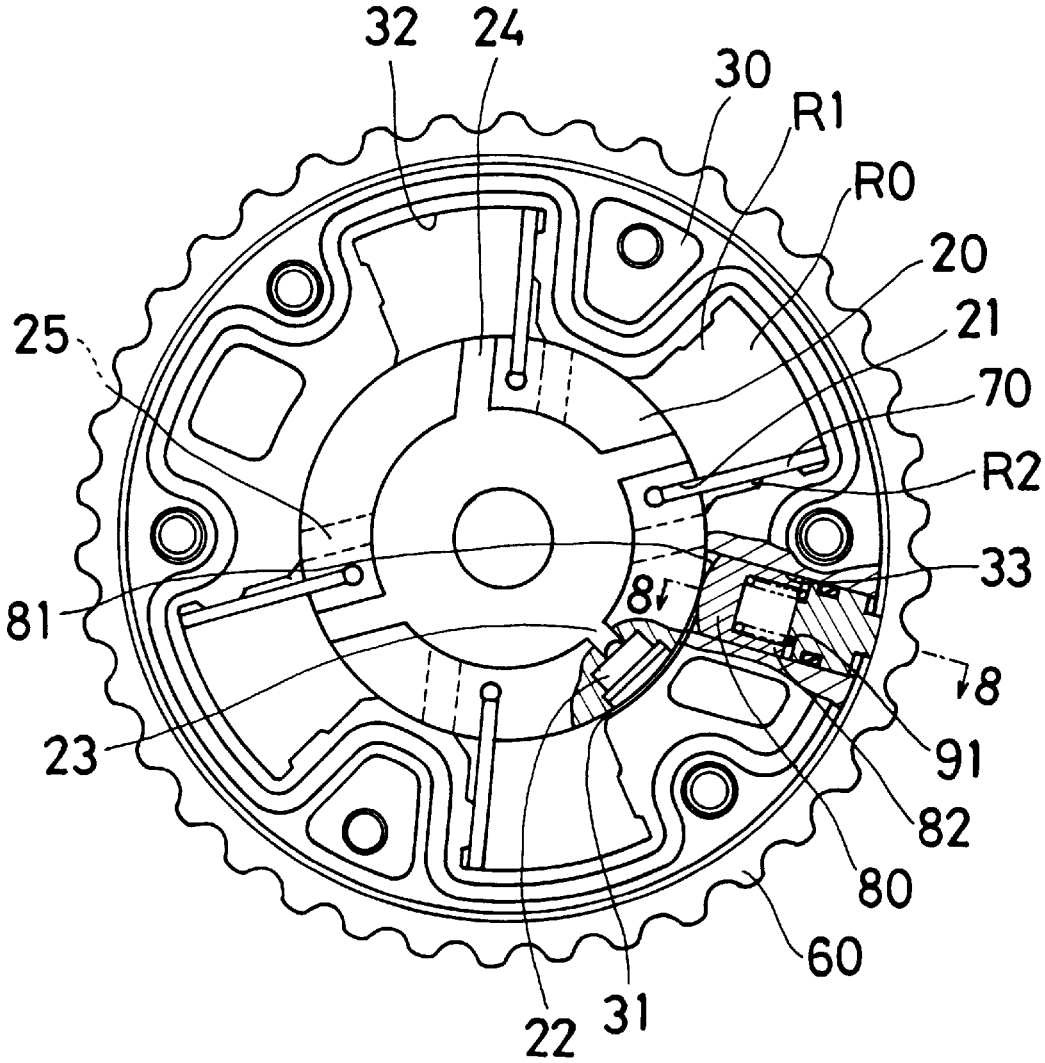
Figure 8:
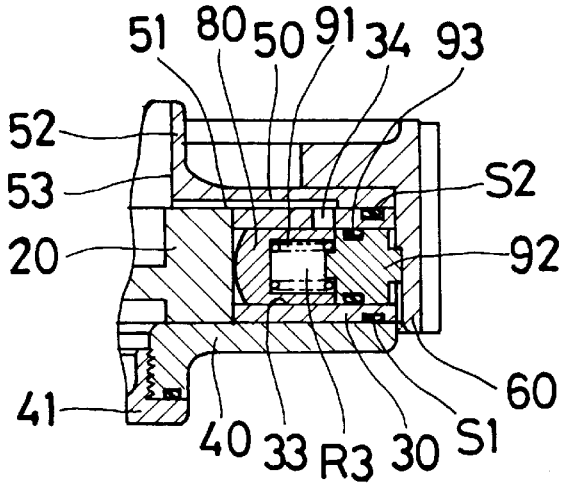
FIG. 8 is a section taken along line 8—8 of FIG. 7.

When the solenoid 103 of the change-over valve 100 is switched in the state of FIGS. 7 and 8 from the energized state to the deenergized state, the working oil is fed from the change-over valve 100 to the delay passage 12 of the cam shaft 10 so that it is fed via the individual passages 25 to the individual delaying chambers R2 and is discharged to the outside from the individual advancing chambers R1 via either the individual passages 24 or the passage 31, the fitting hole 22, the passage 23, the advance passage 11, the change-over valve 100 and so on. As a result, the shaft side member including the cam shaft 10, the internal rotor 20 and the vanes 70 rotates relative to the rotation transmitting member including the external rotor 30 and the timing pulley 60 to change the state from the one shown in FIGS. 7 and 8 to that shown in FIGS. 2 and 3.

Here, in this embodiment, the clearance C1 between the inner circumference of the external rotor 30 and the outer circumference of the internal rotor 20 is smaller than the clearance C2 between the inner circumference of the boss portion 52 of the rear plate 50 and the outer circumference of the cam shaft 10. Therefore, the rotation transmitting member including the external rotor 30, the front plate 40, the rear plate 50 and the timing pulley 60 is rotatably supported to the outer circumference of the internal rotor 20. Thereby, the precision of manufacturing both the inner circumference of the boss portion 52 of the rear plate 50 and the outer circumference of the cam shaft 10 can be rough so as to decrease the manufacturing cost. When the rotation transmitting member is assembled with the cam shaft 10, there is no need to align the center of the rotation transmitting member with the cam shaft 10 so as to decrease the manufacturing cost.

In addition, in this embodiment, the working oil having leaked into the back pressure chamber R3 through the clearance between the refuge hole 33 and the lock pin 80 can be discharged into the cylinder head 110 via the communication passages (i.e., the passage hole 34 formed in the external rotor 30, the communication grooves 51 and 53 formed in the rear plate 50, and the communication hole 113 formed in the cam shaft supporting portion 112 of the cylinder head 110). This discharge makes it possible to suppress poor engagement between the timing pulley 60 and the timing belt and premature deterioration of the same belt as might otherwise be caused by wetting due to the working oil having leaked. Since the aforementioned communication passages can provide the shortest communication between the back pressure chamber R3 and the inside of the cylinder head 110, moreover, the passage resistance can be so lowered as to discharge the working oil having leaked into the back pressure chamber quickly and properly into the cylinder head 110 thereby to optimize the unlocking action of the lock pin 80.

Since the working oil under pressure is not fed to the inside of the back pressure chamber R3, on the other hand, malfunctions and fine vibration in the lock pin 80 can be eliminated in tuning the lock timing of the lock pin 80 by changing the force of the spring 91 for urging the lock pin 80.

On the other hand, the embodiment has been constructed such that the head portion 81 of the lock pin 80 assembled with the external rotor 30 in the state, where the advancing chambers R1 take the minimum capacity (the most delayed state of FIG. 2), is fitted in the fitting hole 22 of the internal rotor 20. However, the construction can be modified such that the head portion 81 of the lock pin 80, as assembled with the external rotor 30, is fitted in the fitting hole 22 of the internal rotor 20 in the state where the delaying chambers R2 take the minimum capacity (the most advanced state of FIG. 7).

In the embodiment, the rotation transmitting member transmits the rotating power from the crank pulley 61 via a timing belt 62 of a resin or rubber and the timing pulley 60. It is possible to replace the timing pulley 60 with a timing sprocket (although not shown) so as to transmit rotating power to the rotation transmitting member from the crank pulley 61 via a timing chain and the timing sprocket.

In the foregoing embodiment, on the other hand, the advance passage 11 is connected to the connection port 101 of the change-over valve 100, and the delay passage 12 is connected to the connection port 102 of the change-over valve 100. In order that the delay passage 12 may be fed with the working oil from the not-shown oil pump, while the solenoid 103 of the change-over valve 100 is deenergized, and so that the advance passage 11 may be fed with the same working oil while the same is energized, the advance passage 11 can be connected with the connection port 102 of the change-over valve 100. Further, the delay passage 12 can be connected to the connection port 101 of the change-over valve 100.

Figure 9:
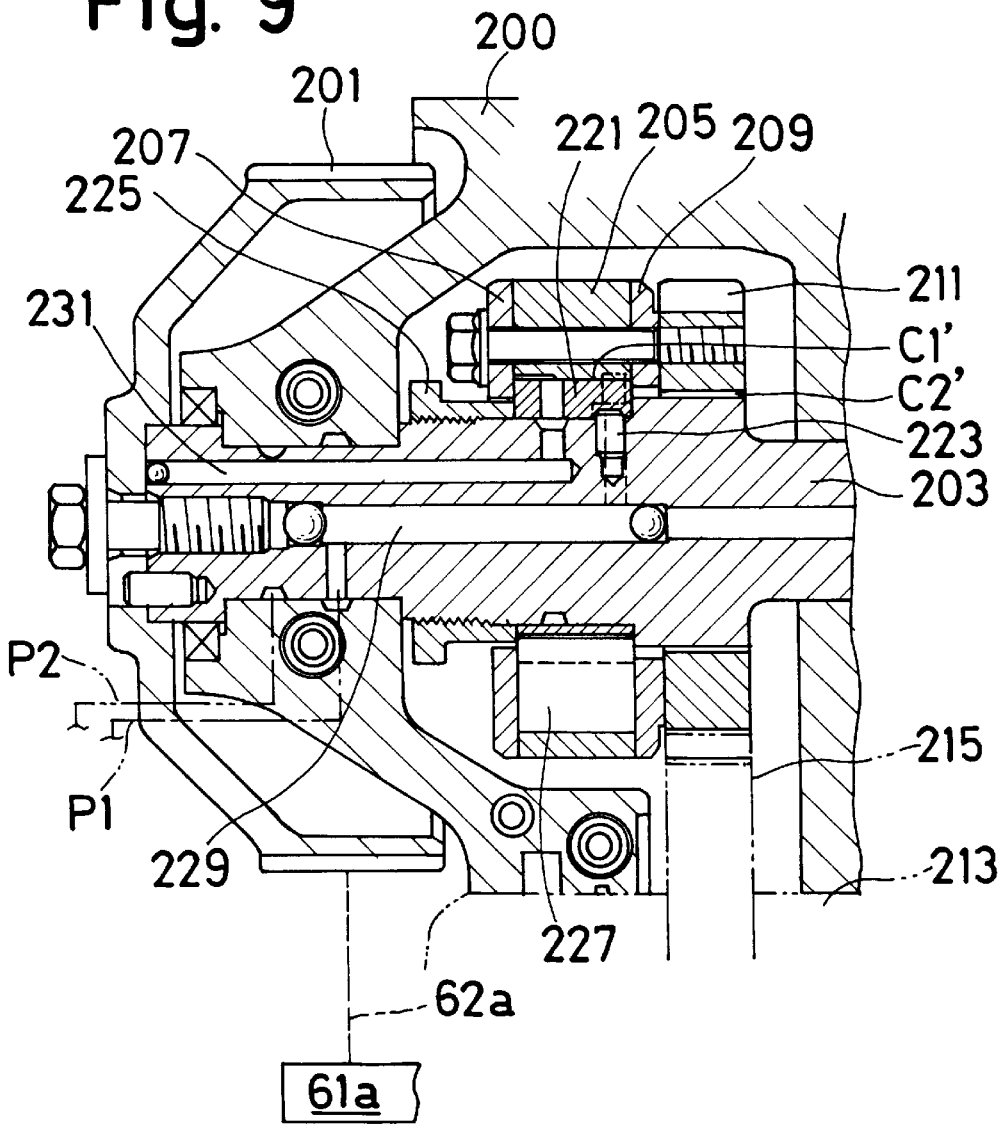
FIG. 9 is a longitudinal section schematically showing another embodiment of a valve timing control device according to the invention.

As shown in FIG. 9, there is another embodiment of the present invention. The valve timing control device is constructed so as to comprise an exhaust valve opening/closing shaft 203 which includes a timing pulley 201 integrally, and which is rotatably supported by a cylinder head 200 of an internal combustion engine, and an internal rotor 221 integrally provided with the exhaust valve opening/closing shaft 203; a rotation transmitting member mounted around the exhaust valve opening/closing shaft 203 so as to rotate relative thereto within a predetermined range and including an external rotor 205, a front plate 207, a rear plate 209 and a drive gear 211; and an intake valve opening/closing shaft 213 including a drive gear 215 engaged with the drive gear 211. The timing pulley 201 is constructed to transmit the rotating power from the crank pulley 61*a* through a timing belt 62*a* as shown in FIG. 9. The intake valve opening/closing shaft 213 is rotated within the predetermined range toward the exhaust valve opening/closing shaft 203.

In the embodiment of FIG. 9, the internal rotor 221 is integrally provided with the exhaust valve opening/closing shaft 203 by a knock pin 223 and a nut 225. In the inner circumference of the external rotor 205, the external rotor 205 is so assembled with the outer circumference of the internal rotor 221 as to rotate relative thereto within a predetermined range. There is a clearance C1' between the inner circumference of the external rotor 205 and the outer circumference of the internal rotor 221. The clearance C1' is set at a predetermined dimension which is a very small value, in which working oil lies. In the inner circumferences of the rear plate 209 and the drive gear 211, both the rear plate 209 and the drive gear 211 are rotatably assembled with the exhaust valve opening/closing shaft 203 via a clearance C2'.

Here, in this embodiment, the clearance C1' between the inner circumference of the external rotor 205 and the outer circumference of the internal rotor 211 is smaller than the clearance C2' between the inner circumference of the rear plate 209 and the outer circumference of exhaust valve opening/closing shaft 203. Therefore, the rotation transmitting member including the external rotor 205, the front plate 207, the rear plate 209 and the drive gear 211 is rotatably supported on the outer circumference of the internal rotor 221. Thereby, the precision of manufacturing both the inner circumference of the rear plate 50 and the outer circumference of the exhaust valve opening/closing shaft 203 can be rough so as to decrease the manufacturing cost. When the rotation transmitting member is assembled with the exhaust valve opening/closing shaft 203, it is not necessary to align the center of the rotation transmitting member and the exhaust valve opening/closing shaft 203 so as to decrease the manufacturing cost, too.

In the embodiment of FIG. 9, the internal rotor 221 includes a plurality of vanes 227. The exhaust valve opening/closing shaft 203 has an advance passage 229 which is connected to a connection port of a changeover valve (not shown) via connection passage P1' and a delay passage 231 which is connected to a connection port of a changeover valve (not shown) via connection passage P2'. The advance passage is connected with the advancing chambers (not shown). The delay passage 231 is connected with the delaying chambers (not shown). The intake valve opening/closing shaft 213 is rotated within the predetermined range toward the exhaust valve opening/closing shaft 203, subject to the operation of the changeover valve in a manner similar to the operation shown in FIGS. 1 to 8.

While the invention has been described in detail and with reference to specific embodiments thereof, it will be apparent to one skilled in the art that various changes and modifications can be made therein without departing from the spirit and scope thereof.

What is claimed is:

1. A valve timing control device for controlling the opening and closing timing of the intake valve or exhaust valve of an internal combustion engine, comprising;

a valve opening and closing rotary shaft rotatably assembled with a cylinder head of an internal combustion engine;

a rotor integrally provided on the rotary shaft;

a rotation transmitting member including a first mounting portion which is mounted around a peripheral surface of the rotor and a second mounting portion which is mounted around a peripheral surface of the rotary shaft, so as to rotate relative thereto within a predetermined range for transmitting rotating power from a crank pulley;

a plurality of vanes provided on at least one of the rotor and the rotation transmitting member;

a fluid chamber formed between the rotor and the rotation transmitting member, and separated into advancing chambers and delaying chambers by the vanes;

first fluid passages for feeding and discharging a fluid to and from the advancing chambers; and second fluid passages for feeding and discharging the fluid to and from the delaying chambers; wherein a clearance between the first mounting portion of the rotation transmitting member and the peripheral surface of the rotor is smaller than a clearance between the second mounting portion of the rotation transmitting member and the peripheral surface of the rotary shaft.

2. A valve timing control device according to claim 1, wherein the rotation transmitting member includes an external rotor having the first mounting portion, a front plate and a rear plate having the second mounting portion.

3. A valve timing control device according to claim 1, wherein the clearance between the second mounting portion of the rotation transmitting member and the peripheral surface of the rotary shaft is a third fluid passage which extends from the fluid chamber to the cylinder head of the internal combustion engine.

* * * * *